US006637064B2

(12) United States Patent
Silverman et al.

(10) Patent No.: US 6,637,064 B2
(45) Date of Patent: Oct. 28, 2003

(54) DRAIN CLEANING APPARATUS WITH REMOTELY ADJUSTABLE FEED CONTROL

(76) Inventors: Lee H. Silverman, 2235 Harmain Rd., Pittsburgh, PA (US) 15235; Arthur A. Silverman, 2245 Harmain Rd., Pittsburgh, PA (US) 15235

( * ) Notice: Subject to any disclaimer, the term of this patent is extended or adjusted under 35 U.S.C. 154(b) by 418 days.

(21) Appl. No.: 09/753,181

(22) Filed: Jan. 2, 2001

(65) Prior Publication Data

US 2002/0083538 A1 Jul. 4, 2002

(51) Int. Cl.[7] ..... B08B 9/02; B08B 1/00; B08B 7/00

(52) U.S. Cl. ..... 15/104.33; 15/104.31; 15/104.32

(58) Field of Search ..... 15/104.31, 104.33, 15/104.32

(56) References Cited

U.S. PATENT DOCUMENTS 2,608,421 A * 8/1952 Schnepp ..... 285/222.5
4,580,306 A * 4/1986 Irwin ..... 15/104.33
5,031,263 A * 7/1991 Babb et al. ..... 15/104.33
5,239,724 A 8/1993 Salecker et al. ..... 15/104.33
5,507,062 A 4/1996 Salecker ..... 15/104.33
5,901,401 A 5/1999 Rutkowski et al. ..... 15/104.33
6,009,588 A 1/2000 Rutkowski ..... 15/104.33
6,470,525 B1 * 10/2002 Silverman ..... 15/104.33

* cited by examiner

*Primary Examiner*—Robert J. Warden, Sr.
*Assistant Examiner*—Laura C Cole
(74) *Attorney, Agent, or Firm*—Metz Lewis LLC; Barry I. Friedman; Philip E. Levy

(57) ABSTRACT

A drain cleaning apparatus has a remotely adjustable cable feed control. The drain cleaning apparatus includes a rotatable cable drum that carries a drain cleaning cable. Also included is a cable advancing mechanism. The cable is adapted to pass from the cable drum and through the cable advancing mechanism. The cable is also adapted to rotate about its feed or longitudinal axis when the cable drum is rotated. The cable advancing mechanism includes a plurality of rollers for engaging the cable. The rollers are selectively adjustable among a cable displacing position and a neutral position. A guide conduit assembly is coupled to the cable advancing mechanism. The rollers may be selectively adjusted between the cable displacing and the neutral positions by an operator remotely rotating the guide conduit.

17 Claims, 10 Drawing Sheets

DRAIN CLEANING APPARATUS WITH REMOTELY ADJUSTABLE FEED CONTROL

FIELD OF THE INVENTION

The present invention relates to a drain cleaning apparatus and, more particularly, to a drain cleaning apparatus having a remotely adjustable feed control for controlling the feeding of a drain cleaning cable.

BACKGROUND AND DESCRIPTION OF THE PRIOR ART

One type of common prior art drain cleaning apparatus in wide use today comprises a cable drum that carries a conventional drain cleaning cable mounted on a wheeled cart or stationary frame. The cable drum is mounted such that it may be rotated relative to the wheeled cart or frame by a motor provided therewith. The drain cleaning cable is conventionally an elongate, flexible member made of tightly wound spring wire and is wound about the central axis of the cable drum and is thus rotatable with the cable drum. The free or outer end of the drain cleaning cable is adapted to be pulled from the cable drum for use in cleaning a drain and pushed back into the cable drum for storage during periods of non-use.

It is known in the art that a rotating cylindrical member, such as a drain cleaning cable, can be advanced by using a plurality of rollers that engage the cylindrical member. Typically, the rollers are mounted on a frame or housing that has an opening with an axis that aligns with the central axis of the cylindrical member to be advanced. In some prior art devices, the rollers have rotational axes that are simultaneously variable to control the direction of advancement of the rotating cylindrical member.

Such rollers have been used in prior art drain cleaning apparatuses to advance or feed a drain cleaning cable both in and out of a rotating cable drum. One such prior art drain cleaning apparatus is described in Salecker et al., U.S. Pat. No. 5,507,062, the disclosure of which is incorporated herein by reference.

FIGS. 1 and 2 show the drain cleaning apparatus described in Salecker et al., which includes a cable drum 12 mounted on a wheeled cart 14. The cable drum 12 carries a drain cleaning cable 16 and is mounted for rotation by a motor 18 relative to the wheeled cart 14. A mechanism for advancing the drain cleaning cable 16 is shown generally at 10. The mechanism 10 has a frame 20 defining an opening 22 through which the drain cleaning cable 16 is directed for advancement thereof in a line substantially parallel to the length of the drain cleaning cable 16. The mechanism 10 has a rigid bracket 23 that is fixedly mounted upon an upright support 24 on the cart so that the rotational axis of the cable drum 12 coincides with the central axis 26 of the frame opening 22. Advancing rollers 28, 30 and 32 project into the frame opening 22 and have peripheral surfaces 34, 36, and 38 which cooperatively define an effective diameter for receipt of the drain cleaning cable 16.

The rollers 28, 30 and 32 rotate relative to the frame 20 about spaced axes 40, 42, and 44, respectively. With the axes 40, 42 and 44 parallel to the central axis 26 of the frame opening 22, the device is in neutral position. That is, the drain cleaning cable 16 being rotated by the cable drum 12 effects rotation of the rollers 28, 30 and 32 without the drain cleaning cable 16 being withdrawn into the cable drum 12 or advanced therefrom. Through a control arm 46, the axes 40, 42 and 44 of the rollers 28, 30 and 32 can be reoriented. With the control arm 46 moved to a forward advance position, shown in FIG. 2, the roller axis 40, 42 and 44 are uniformly angled relative to the frame opening axis 26 to thereby define a helical engagement path which results in the advancement of the drain cleaning cable forwardly out of the cable drum 12. Pivoting of the control arm 46 through approximately 90°, in a counter-clockwise direction in FIG. 2, places the advancing mechanism 10 in a reverse mode position. In this mode, the axes 40, 42 and 44 are simultaneously repositioned through approximately 90° from the position they occupied with the control arm 46 in the forward position. This results in the advancement or feeding of the drain cleaning cable 16 in a reverse direction, i.e., back into the cable drum 12.

One drawback of the drain cleaning apparatus described in Salecker et al. is that in order to adjust the operation of the mechanism 10 among the neutral, forward advancing, and reverse advancing positions, the user must be in proximity with the mechanism 10 so as to have access to the control arm 46. When cleaning a drain, it is often not possible to move the drain cleaning apparatus comprising the cable drum 12 and wheeled cart 14 close to the opening of the drain due to, for example, some obstruction. In such a case, the user must take out a substantial length of drain cleaning cable 16 to reach the work area surrounding the opening to the drain. Because in such a case the work area is a distance away from the mechanism 10, the user cannot readily reach the control arm 46 to adjust the drain cleaning apparatus among the various operating positions.

Another prior art drain cleaning apparatus is described in Rutkowski, U.S. Pat. No. 6,009,588. The drain cleaning apparatus described in Rutkowski includes a rotatable motor driven cable drum carrying a drain cleaning cable that is mounted on a frame. Rutkowski describes a manually operable cable feed device that facilitates the selective feeding of the drain cleaning cable outwardly and inwardly relative to the cable drum. The cable feed device comprises a tubular housing through which the drain cleaning cable is to be fed. The tubular housing includes a pair of cable driving rollers fixedly mounted thereon such that the axis of each driving roller is skewed both horizontally and vertically relative to the central axis of the tubular housing. The tubular housing further includes a radially extending bore which receives a drive actuating roller support member having a drive actuating roller mounted on the inner end thereof. The support member supports the drive actuating roller in the tubular housing such that the axis of the drive actuating roller is skewed horizontally with respect to the axis of the tubular housing, preferably at the same angle as that of the driving rollers. The drive actuating roller support member is mounted so as to be biased outward from the tubular housing. A lever and handle are provided with the tubular housing for engaging and working against the outward biasing of the support member so as to move the support member and attached drive actuating roller within the tubular housing.

In operation, when the lever is in a disengaged position such that the support member is biased away from the central axis of the tubular housing, there is no axial displacement of the cable because the drive actuating roller is disengaged from the cable. When the handle of the lever is displaced downwardly, the support member is displaced radially inward against the cable to displace the cable against the drive rollers. As a result of the skewed position of the rollers, they interengage with the rotating cable to cause the cable to be fed in a direction relative to the tubular housing which depends on the direction of rotation of the cable, which in turns depends on the direction of rotation on the cable drum. Rotation of the cable in one direction advances it axially outward from the tubular housing, while rotation of the cable in the opposite direction draws the cable axially inward. When it is desired to stop the displacement of the cable in either direction, the handle is released and the drive actuating roller disengages the cable.

According to one embodiment described in Rutkowski, the cable feed device is mounted on the outer end of a flexible guide tube assembly affixed to the cable drum. While this embodiment allows a user to start and stop displacement of a cable at the work area, i.e., the opening to the drain, the direction of displacement of the cable can only be controlled by controlling the direction of rotation of the cable drum. Typically, the direction of rotation of the cable drum is controlled at the location of the cable drum itself, which in many applications is not within reach of the work area. Furthermore, when mounted at the end of a freestyle guide tube, the operations of the cable feed device is negatively impacted as the length and flex of the guide tube are increased. As length is increased, the friction of the rotating cable within the guide tube is also increased as a function of surface area in contact therebetween. This increase in friction is exacerbated by the distortion of the flexible guide tube during use. Irrespective of the length of the guide tube, the bending of the tube in use distorts the cross-sectional shape of the tube from circular to ellipsoidal and creates significant friction against and compression of the cable. As the cable is rotated within the tube, buildup of such frictional stresses can cause binding, kinking and looping of the cable within the tube, which deteriorates performance significantly.

SUMMARY OF THE INVENTION

Described is a drain cleaning apparatus having a remotely adjustable cable feed control. The drain cleaning apparatus includes a rotatable cable drum that carries a drain cleaning cable. Also included is a cable advancing mechanism mounted adjacent said drum having a housing that has an inner bore and a feed axis. The cable is adapted to pass from the cable drum and through the inner bore of the housing along the feed axis. The cable is also adapted to rotate about the feed axis when the cable drum is rotated. The cable advancing mechanism includes a plurality of rollers for engaging the cable. The rollers are selectively adjustable among a series of cable displacing positions preferably being a forward advancing position in which the cable, when rotating in a first direction, is fed out of the cable drum and along the feed axis and a reverse advancing position in which the cable, when also rotating in said first direction, is fed into the cable drum and along the feed axis. The rollers may also be placed in a neutral position in which the cable, when rotating in the first direction, is not fed along the feed axis. A conduit assembly is coupled to the cable advancing mechanism. The conduit assembly preferably includes an adjusting component and a guidecomponent, with the guide component preferably being located concentrically within the adjusting component. The guide component is adapted to receive the cable. The rollers may be selectively adjusted among the forward advancing, the reverse advancing and the neutral positions by rotating the adjusting conduit about its longitudinal axis by manual force. Additionally, a single component conduit may be utilized which maintains the flexibility and torsional strength characteristics to perform the functions set out herein. The rollers each have a rotational axis. In the neutral position, the rotational axes of the rollers are substantially parallel to the feed axis of the cable, and in the forward advancing and reverse advancing positions, the axes of the rollers are angled with respect to the feed axis of the cable. It is to be specifically noted that the operation of the feed control is continuous and infinitely adjustable from the neutral to the forward and reverse positions, allowing the user to select the speed of the cable throughput.

The conduit assembly may be removably yet rigidly attached to the cable advancing mechanism. Furthermore, each of the rollers may be rotatably supported by a carrier having a central axis wherein the carriers are mounted in the housing such that the central axes are substantially orthogonal to the feed axis and such that the carriers are rotatable about the central axes.

The cable advancing mechanism may include a cover plate rotatably affixed to the housing wherein the carriers that support the rollers are coupled to the cover plate such that rotation of the cover plate with respect to the housing causes the carriers to rotate about the central axes. In such a configuration, the neutral position corresponds to a first rotational position of the cover plate with respect to the housing and a first rotational position of the carriers, the forward advancing position corresponds to a second rotational position of the cover plate with respect to the housing and a second rotational position of the carriers, and the reverse advancing position corresponds to a third rotational position of the cover plate with respect to the housing and a third rotational position of the carriers. The conduit assembly may be attached to the cover plate such that the rotation of the adjusting conduit about its longitudinal axis simultaneously causes the cover plate to rotate with respect to the housing.

The housing may include a first indent and the cover plate may include a second indent wherein the first indent aligns with the second indent when the cover plate is positioned with respect to the housing so as to place the rollers in the neutral position. In this configuration, the drain cleaning apparatus includes a ball bearing and a spring inserted between the first and second indents when the first and second indents are aligned with one another. Additionally, it is to be understood that any device known to those skilled in the art may be substituted to identify the neutral position and temporarily restrain the rotation of the cover plate at that position.

These and other advantages and features of the present invention will be more fully understood with reference to the appended drawings and the description of the preferred embodiments.

BRIEF DESCRIPTION OF THE DRAWINGS

Further features and advantages of the present invention will be apparent upon consideration of the following detailed description of the present invention, taken in conjunction with the following drawings, in which like reference characters refers to like parts, and in which.

DESCRIPTION OF THE PREFERRED EMBODIMENTS

Figure 1:
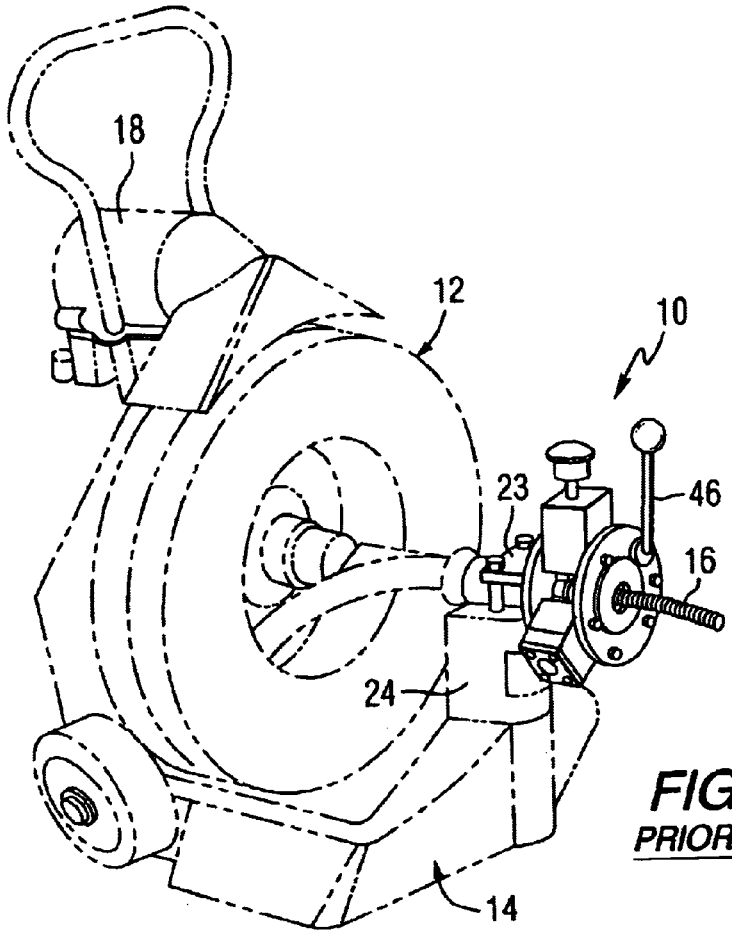
FIG. 1 PRIOR ART
FIG. 1 is an isometric view of a prior art drain cleaning apparatus.
Figure 2:
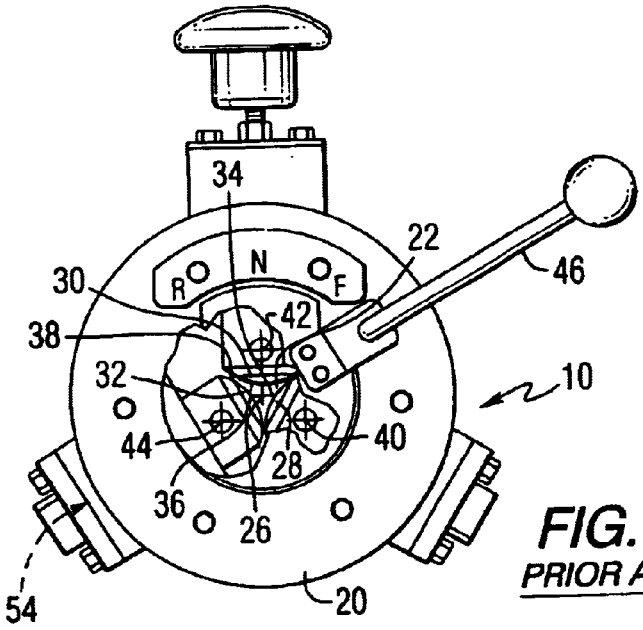
FIG. 2 PRIOR ART
FIG. 2 is a front view of a prior art mechanism for advancing a rotating drain cleaning cable forming a part of the drain cleaning apparatus shown in FIG. 1.
Figure 3:
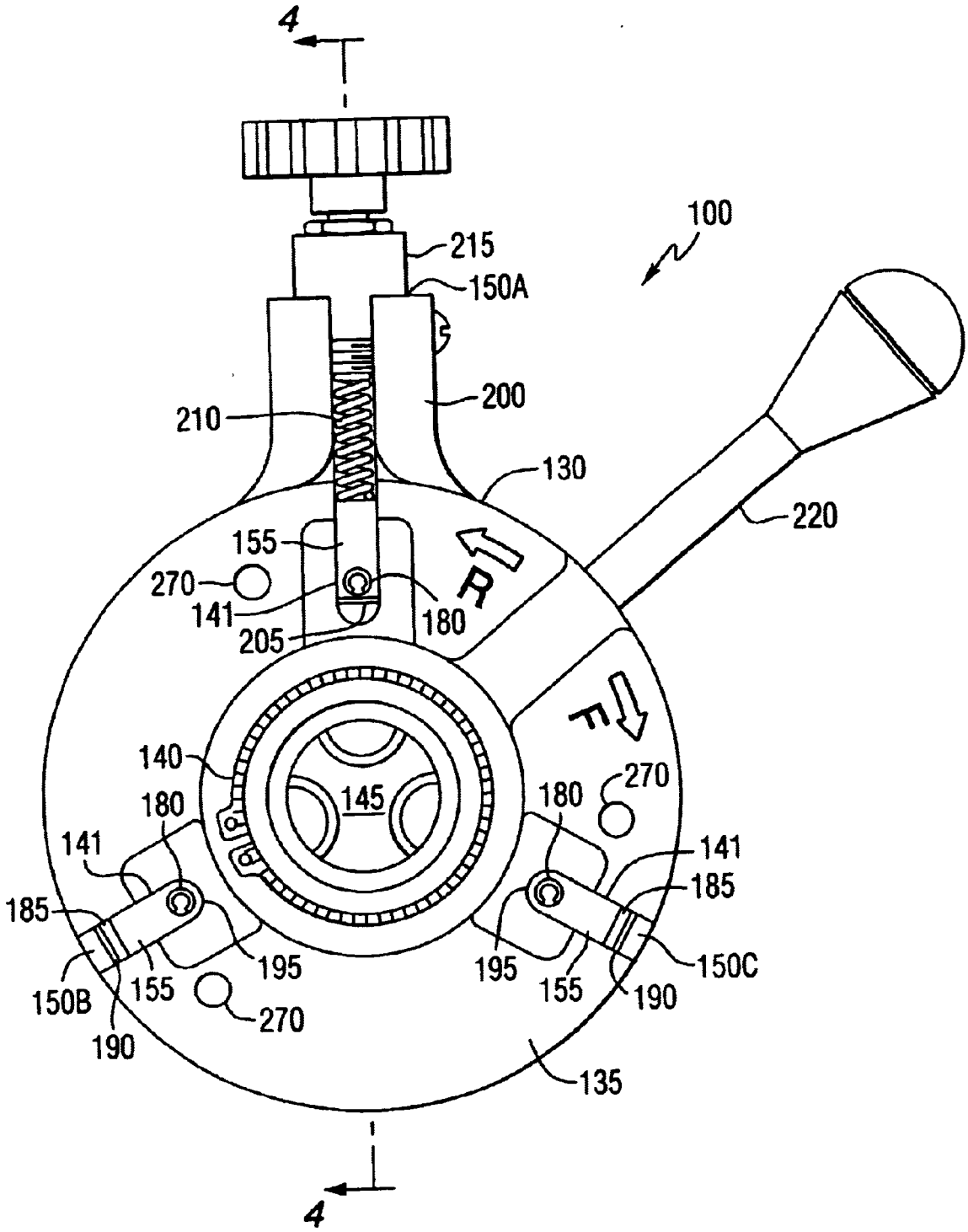
FIG. 3 is a front view of a cable advancing mechanism forming a part of the drain cleaning apparatus of the present invention.
Figure 3A:
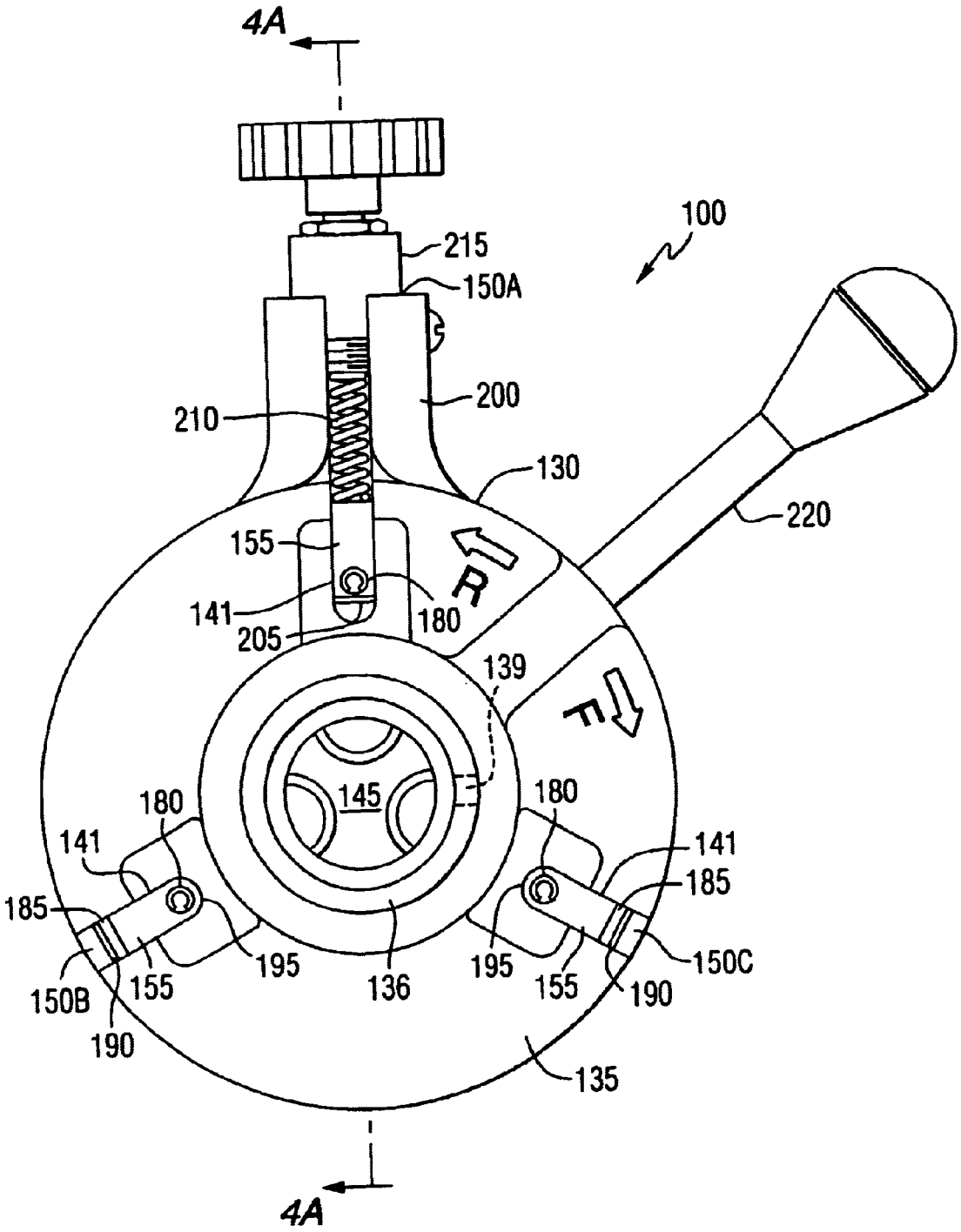
FIG. 3A is a front view of a second embodiment of a cable advancing mechanism forming a part of the drain cleaning apparatus of the present invention.
Figure 4:
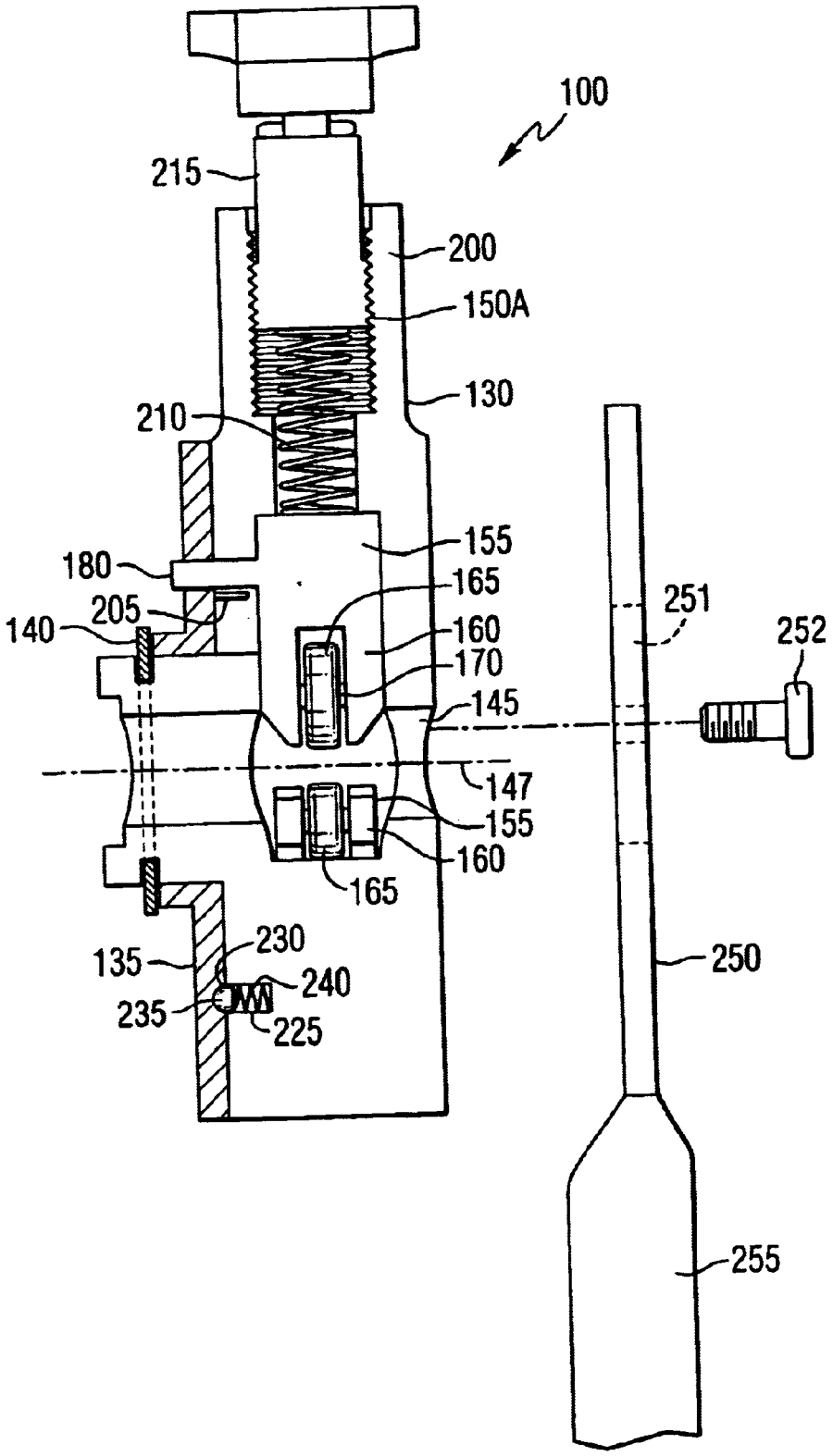
FIG. 4 is a cross-sectional diagram of the cable advancing mechanism shown in FIG. 3 taken along lines 4—4 in FIG. 3.
Figure 4A:
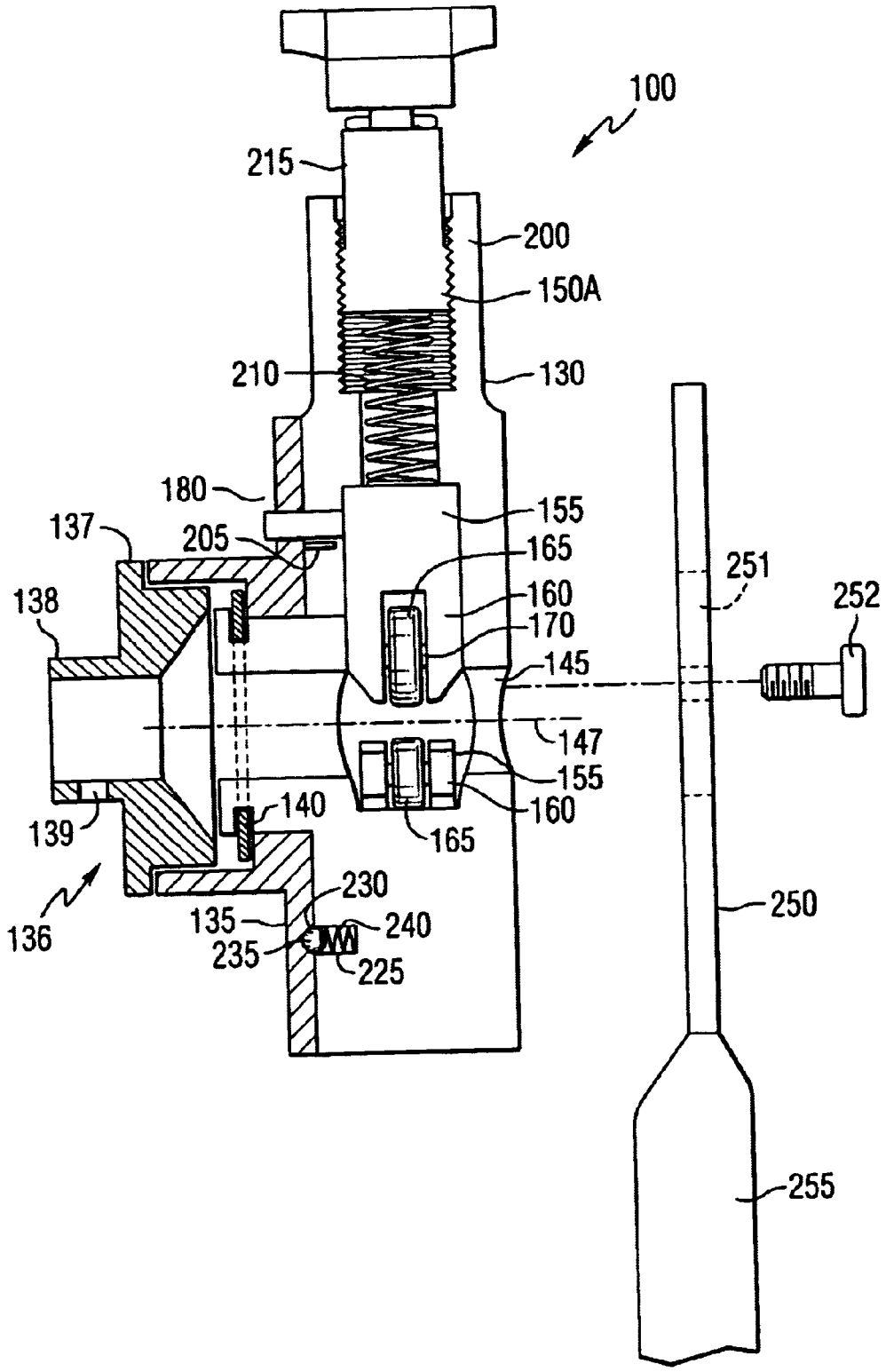
FIG. 4A is a cross-sectional diagram of a second embodiment of the cable advancing mechanism shown in FIG. 3A taken along lines 4A—4A in FIG. 3A.
Figure 5:
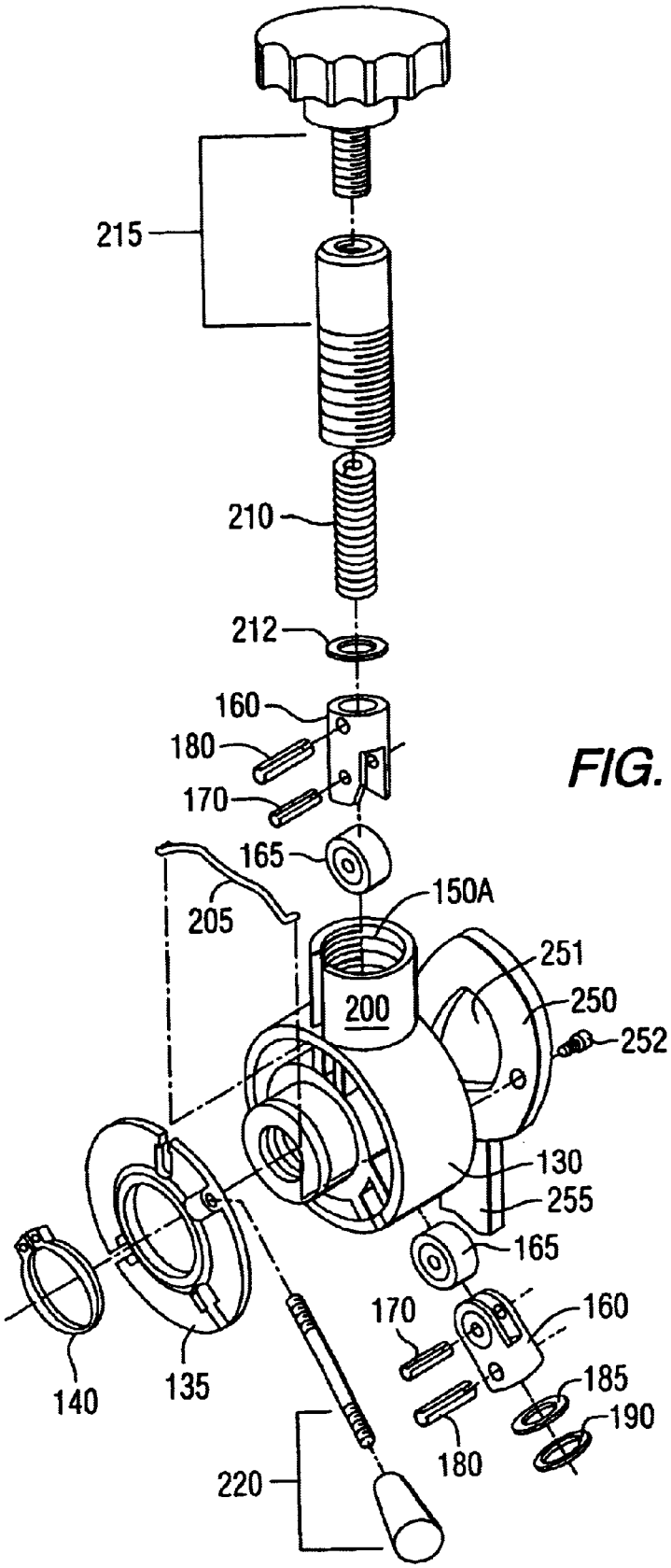
FIG. 5 is an exploded isometric view of the cable advancing mechanism shown in FIGS. 3 and 4.
Figure 5A:
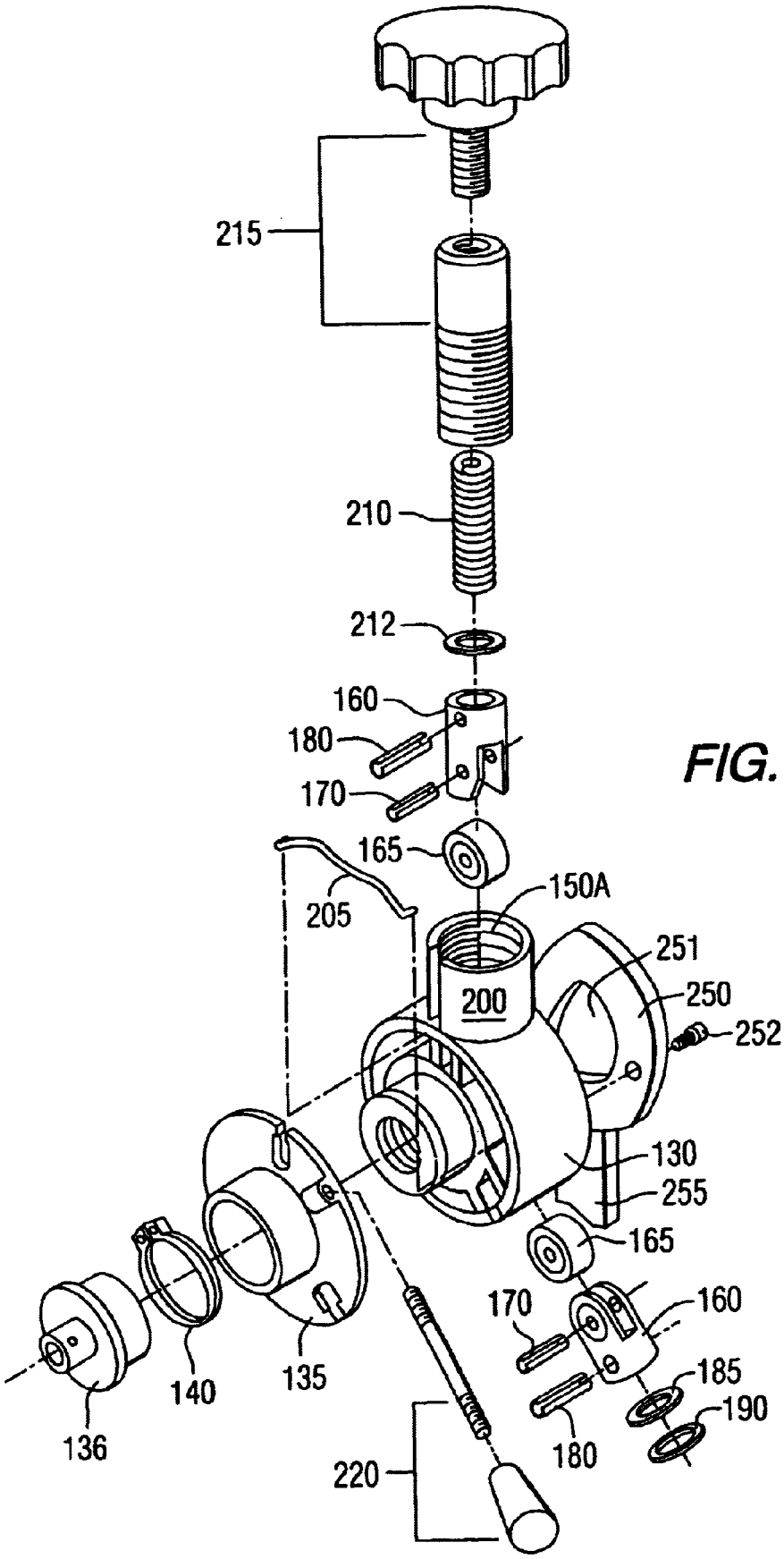
FIG. 5A is an exploded isometric view of the cable advancing mechanism shown in FIGS. 3A and 4A.
Figure 7:
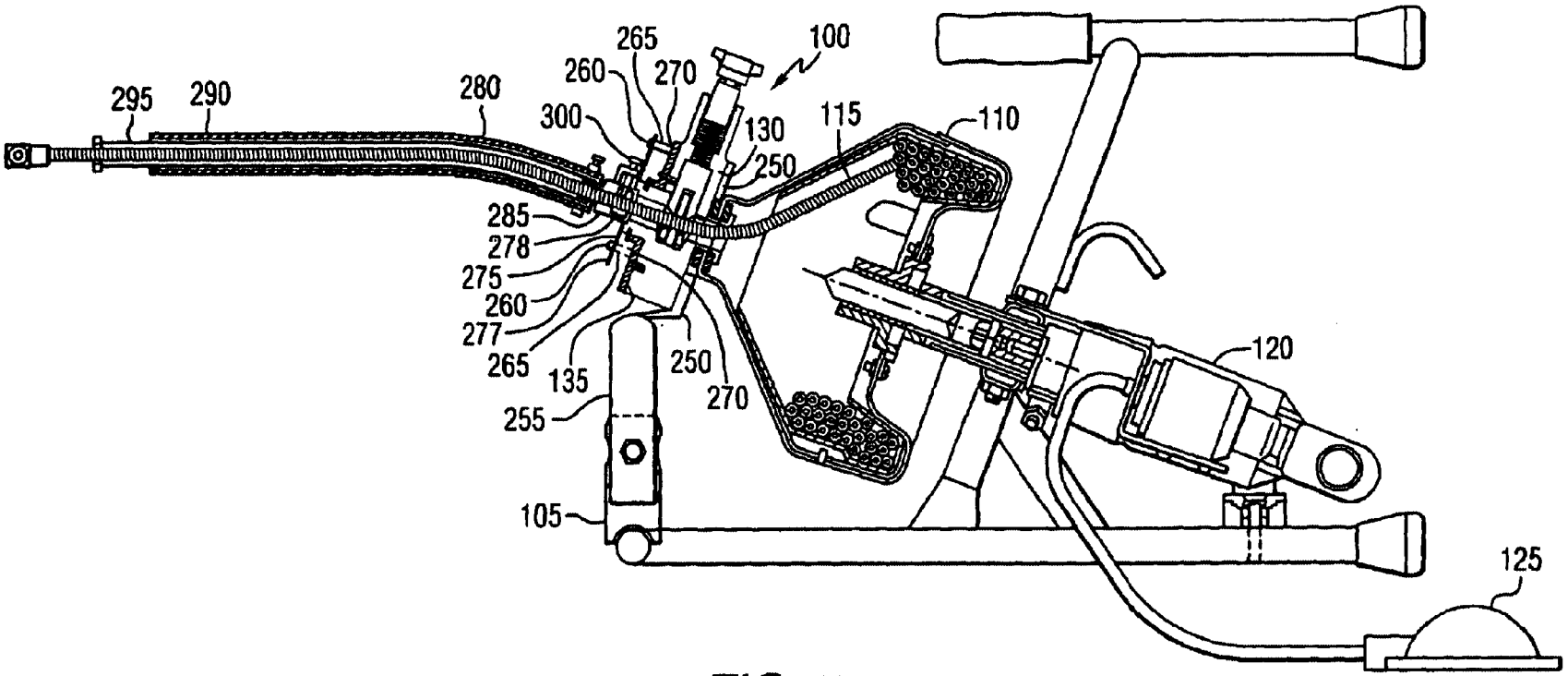
FIG. 7 is a side view partially in cross-section of a drain cleaning apparatus according to a first embodiment of the present invention.
Figure 7A:
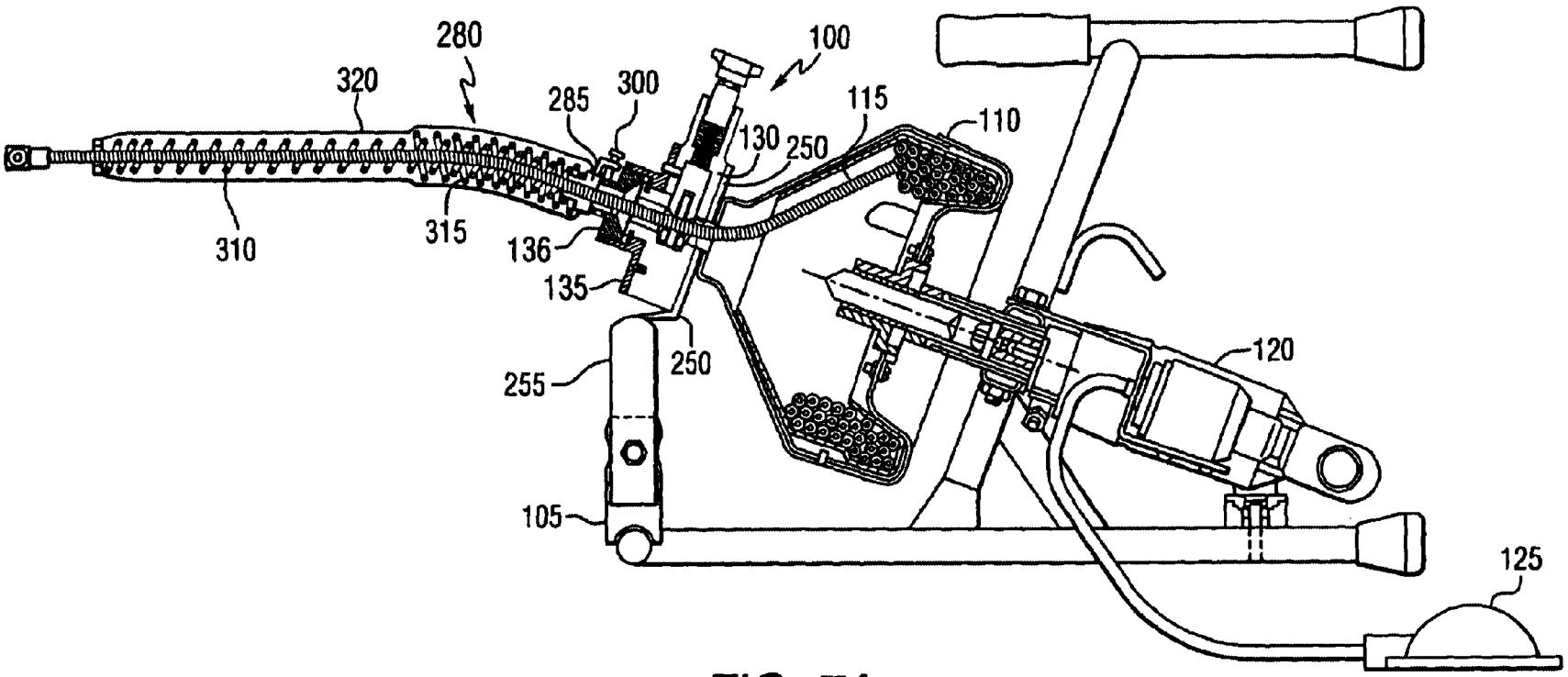
FIG. 7A is a side view partially in cross-section of a drain cleaning apparatus according to a second embodiment of the present invention.

Referring to FIGS. 3 and 3A, a front view of cable advancing mechanism 100 according to the present invention is shown. FIGS. 4 and 4A are cross-sectional diagrams of cable advancing mechanism 100 taken along line 4—4 in FIG. 3 and line 4A—4A in FIG. 3A and FIGS. 5 and 5A are exploded isometric views of cable advancing mechanism 100. FIGS. 7 and 7A are diagrams partially in cross section showing cable advancing mechanism 100 affixed to and operatively associated with a drain cleaning apparatus having support frame 105, rotatable cable drum 110 carrying cable 115, and motor 120 controlled by pedal 125 that is coupled to and rotates cable drum 110. Each set of Figures illustrates corresponding views of two embodiments of the device. A first embodiment is shown in FIGS. 3, 4, 5 and 7. A second embodiment, which is the preferred embodiment, is shown in FIGS. 3A, 4A, 5A and 7A. Cable advancing mechanism 100 is mounted directly to mounting support 250 which is itself supported on mounting support riser 255. Mounting support 250 is provided as a flat, circular plate having a port 251 therethrough for the passage of the cable 115 from cable drum 110. Mounting screws 252 or any conventional affixation known in the art are used to secure the connection. Mounting support 250 may be angled with respect to support risers 255 to tilt cable advancing mechanism 100 slightly upward as viewed from the front. Cable advancing mechanism 100 includes housing 130 having cover plate 135 removably affixed thereto by snap ring 140. With reference to FIGS. 3A, 4A and 7A, specifically, conduit mounting cap 136 is secured to housing 130 by any conventional means, such as a set screw (not shown). Conduit mounting cap 136 has a base flange 137 and a conduit mounting post 138 extending therefrom for receiving and restraining the guide conduit assembly 280. A receptacle 139 is provided in conduit mounting post 138 to receive spring biased pin 300 to secure guide conduit assembly 280 thereto. Cover plate 135 includes cutout portions 141. Housing 130 has inner bore 145 having a central axis 147 through which cable 115 is directed for advancement or feeding out of, i.e., the forward direction, and into, i.e., the reverse direction, cable drum 110 according to the present invention.

Figure 6A:
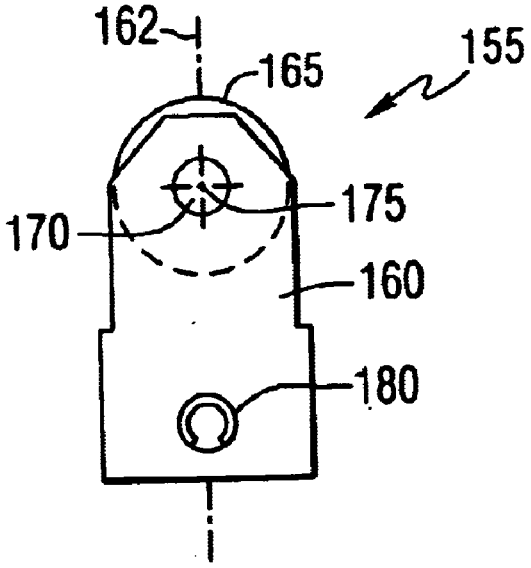
FIGS. 6A and 6B are front and side views, respectively, of a roller subassembly forming a part of the advancing mechanism shown in FIGS. 3, 4 and 5.
Figure 6B:
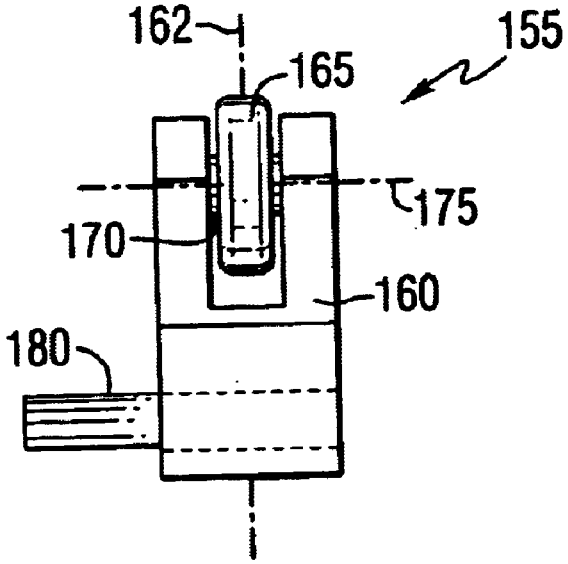

Housing 130 includes bores 150A, 150B and 150C each adapted to receive a roller subassembly 155, shown in FIGS. 6A and 6B, such that each roller 165 of each roller subassembly 155 projects into inner bore 145. As seen in FIGS. 6A and 6B, which are front and side plan views, respectively, of roller subassembly 155, roller subassembly 155 comprises generally cylindrical carrier 160 having a central axis 162 to which roller 165 is rotably affixed by pin 170 such that roller 165 rotates about axis 175.

Carrier 160 includes pin 180 protruding out of the end thereof opposite the end to which roller 165 is affixed.

Referring to FIGS. 3, 3A, 5 and 5A, roller subassemblies 155 inserted into bores 150B and 150C are held in place in housing 130 by shims 185 and snap rings 190. Roller subassemblies 155 are prevented from sliding completely through bores 150B and 150 by edges 195 of cutouts 138 that engage pins 180.

As seen in FIGS. 3, 3A, 4, 4A, 5 and 5A, bore 150A is formed in housing 130 through neck 200 that forms a part of housing 130. Pin 180 of roller subassembly 155 inserted into bore 150A comes to rest on leaf spring 205 mounted on housing 130. Provided on top of roller subassembly 155 inside bore 150A is washer 212 and tensioning spring 210. Threaded plunger 215 is threaded into corresponding threads provided in neck 200 and comes into contact with tensioning spring 210. By turning threaded plunger 215, the force applied to tensioning spring 210 by threaded plunger 215 can be controlled, which in turn controls the force applied to roller subassembly 155 and against leaf spring 205. Roller subassembly 155, and in particular roller 165 thereof, can be selectively positioned inside bore 150A and inner bore 145 by selectively turning threaded plunger 215. As a result, the size of the space defined by roller 165 of each roller subassembly 155 in housing 130 can be adjusted and thus cable advancing mechanism 100 can accommodate cables of different sizes.

Cover plate 135 is adapted to rotate relative to housing 130. Control arm 220 is affixed to cover plate 135 to facilitate the rotation of cover plate 135. With axes 175 of roller subassemblies 155 parallel to axis 147, the cable advancing mechanism is in the neutral position wherein the rotation of cable drum 110 and resulting rotation of cable 115 about axis 147 causes rollers 165 to rotate without cable 115 being fed in either the forward or reverse direction. When cover plate 135 is rotated in a clockwise direction as shown in FIG. 3, the edges of cover plate 135 defined by cutouts 141 engage respective pins 180 of roller subassemblies 155 and cause roller subassemblies 155 to rotate about axes 162 thereof within respective bores 150A, 150B, and 150C. As a result, axes 175 of roller subassemblies 155 are reoriented and are angled relative to axis 147 to thereby define a helical engagement path of rollers 165 with cable 115 which results in advancement of cable 115 in the forward direction out of rotating cable drum 110. When cover plate 135 is rotated in a counterclockwise direction as shown in FIG. 3, the edges of cover plate 135 defined by cutouts 141 engage the opposite side of respective pins 180 of roller subassemblies 155 and cause roller subassemblies 155 to rotate about axes 162 thereof in the opposite direction within respective bores 150A, 150B and 150C. As a result, axes 175 of roller subassemblies 155 are once again reoriented and are angled relative to axis 147 first in the neutral position where cable 115 is not advanced, and then in a position defining a helical engagement path of rollers 165 with cable 115 which results in advancement of cable 115 in the reverse direction into rotating cable drum 110.

Referring to FIGS. 4 and 4A, housing 130 is provided with first indent 225 and cover plate 135 is provided with second indent 230. First indent 225 and second indent 230 are provided such that they align with one another when cover plate 135 is in the neutral position. Ball bearing 235 and spring 240 are inserted in the space defined by first indent 225 and second indent 230 when cover plate 135 is so oriented. As cover plate 135 is then rotated relative to housing 130, ball bearing 235 is forced up against spring 240 and into first indent 225. The configuration of first indent 225, second indent 230, ball bearing 235 and spring 240 thus provides a mechanism for facilitating the finding of the neutral position of cover plate 135 as it is rotated. In particular, a user will find that the cover plate 135 will click into place in the neutral position. It is specifically noted, however, that any temporary locating means may be substituted for said ball and spring embodiment.

Referring to FIGS. 7 and 7A, a drain cleaning apparatus according to present invention is shown in which cable advancing mechanism 100 is rigidly affixed to cable drum 110 by conventional means such that cable 115 passes through inner bore 145 of housing 130 of cable advancing mechanism 100 as it is fed from cable drum 110. Additional support for cable advancing mechanism 100 is provided by mounting support 250, which has one end attached to the back of housing 130 and the other end attached to mounting support riser 255 of support frame 105. In the first embodiment illustrated in FIG. 7, affixed to cover plate 135 by means of screws 260 screwed through spacers 265 and into holes 270 provided in cover plate 135 is mounting plate 275. Mounting plate 275 comprises a flat outer portion 277 and a cylindrical inner portion 278 through which cable 115 passes. Guide conduit assembly 280 is removeably yet rigidly attached to mounting plate 275. Guide conduit assembly 280 comprises collar assembly 285 to which outer adjusting tube 290 and inner guide tube 295 are rigidly affixed by conventional means such as clamping, welding or a threaded collar. As seen in FIG. 7, outer adjusting tube 290 and inner guide tube 295 are concentric with one another and are adapted to receive cable 115 when attached to mounting plate 275. Collar assembly 285 is adapted to fit over cylindrical inner portion 278 of mounting plate 275 and may include spring-biased pin 300 adapted to be inserted into a hole provided in mounting plate 275 for the purpose of removeably yet rigidly attaching tube assembly 280 to mounting plate 275.

In a second embodiment, illustrated in FIG. 7A, conduit mounting cap 136 is mounted by any conventional manner to housing 130 and is adapted to restrain cover plate 135 for rotational motion. Collar assembly 285 is affixed thereto in a similar manner to the first embodiment. It is to be specifically noted that guide conduit assembly 280 may be comprised of flexible tube, plastic or rubber pipe, metallic springs or any combination thereof. Additionally, segmental sections of the same material may be joined for the purpose of creating a unitary whole. Additionally, a unitary conduit may be applied which has sufficient flexibility and torsional strength to activate said cover plate 135 when turned by an operation from a point along its length.

Referring now to FIG. 7A, a preferred embodiment is shown having an inner guide spring 310 and an outer adjusting spring 315. The inner and outer springs are mounted such that their windings are oppositely biased creating at least one point of contact between each winding of the inner and outer springs. This permits the springs to engage and restrain each other, irrespective of the direction of any torsional force on guide conduit assembly 280. The springs are sized such that flexibility of guide conduit assembly 280 is maximized, while retaining the ability of the operator to exert reasonable torsional force on guide conduit assembly 280 at its distal end to rotate cover plate 135. It is considered within the skill in the art to cap either or both of the spring ends. A protective coating 320 is provided to enclose the springs 310 and 315 and is generally constructed of a heat shrinkable elastomeric material.

Inner guide tube 295 or spring 310 is adapted to be handled by a user of the drain cleaning apparatus to guide cable 115 into and within the drain being cleaned. Inner guide tube 295 or spring 310 must thus be capable of sufficient bending to accommodate this purpose.

Outer adjusting tube 290 or spring 315 is provided as a mechanism for remotely, that is from a position removed from cable advancing mechanism 100, adjusting the feeding of cable 115 into and out of cable drum 110. Specifically, outer adjusting tube 290 or spring 315 may be used by a user to selectively rotate cover plate 135 with respect to housing 130 from a position removed from cover plate 135. By doing so, the user can thus selectively reorient axes 175 of roller subassemblies 155 and switch cable advancing mechanism 100 among the neutral, forward advancing and reverse advancing positions. In the first embodiment, outer adjusting tube 290 must be of sufficient torsional rigidity so that when it is twisted and/or turned, cover plate 135 will turn with respect to housing 130. Outer adjusting tube 290 must also be of sufficient flexibility to permit it to bend to accommodate the needs of the user. Outer adjusting tube 290 and inner guide tube 295 are oriented such that outer adjusting tube 290 can be twisted and/or turned independent of inner guide tube 295, thereby enabling a user to hold inner guide tube 295 in one hand while guiding cable 115, and hold and twist and/or turn outer guide tube 290 in the other hand to selectively control the feeding of cable 115. With respect to the second embodiment, springs 310 and 315, encased in coating 320 may provide sufficient torsional strength along entire length to activate to rotation of cover plate 135.

While the presently preferred embodiments of the invention are described, it is to be distinctly understood that the invention is not limited thereto but may be otherwise embodied and practiced within the scope of the following claims:

What is claimed is:

1. A drain cleaning apparatus having a remotely adjustable cable feed control, comprising:

a rotatable cable drum, said cable drum carrying a cable;

a cable advancing mechanism having a housing, said housing having an inner bore having a feed axis, said cable being adapted to pass from said cable drum and through said inner bore of said housing along said feed axis and being adapted to rotate about said feed axis when said cable drum is rotated, said cable advancing mechanism having a plurality of rollers for engaging said cable, said rollers being selectively adjustable between a cable displacing position in which said cable when rotating in a first direction is moved relative to said cable drum and along said feed axis, and a neutral position in which said cable when rotating in said first direction is not fed along said feed axis; and a guide conduit assembly coupled to said cable advancing mechanism, said guide conduit assembly having a longitudinal axis, said guide conduit assembly being rotatable about said longitudinal axis and being adapted to receive said cable along said longitudinal axis;

wherein said rollers may be adjusted between said cable displacing and neutral positions by rotation of said guide conduit assembly about said longitudinal axis.

2. A drain cleaning apparatus according to claim 1, wherein said guide conduit assembly is removeably yet rigidly attached to said cable advancing mechanism.

3. A drain cleaning apparatus according to claim 1, wherein said rollers each have a rotational axis, wherein in said neutral position said rotational axes of said rollers are substantially parallel to said feed axis, and wherein in said cable displacing position said axes of said rollers are angled with respect to said feed axis.

4. A drain cleaning apparatus according to claim 3, wherein each of said rollers is rotatably supported by a carrier having a central axis, said carriers being mounted in said housing such that said central axes are substantially orthogonal to said feed axis and such that said carriers are rotatable about said central axes.

5. A drain cleaning apparatus according to claim 4, wherein said cable advancing mechanism includes a cover plate rotatably affixed to said housing, wherein said carriers are coupled to said cover plate such that rotation of said cover plate with respect to said housing causes said carriers to rotate about said central axes.

6. A drain cleaning apparatus according to claim 5, wherein said neutral position corresponds to a first rotational position of said cover plate with respect to said housing and a first rotational position of said carriers about said central axes and said cable displacing position corresponds to a second rotational position of said cover plate with respect to said housing and a second rotational position of said carriers about said central axes.

7. A drain cleaning apparatus according to claim 6, wherein said guide conduit assembly is attached to said cover plate and wherein rotating said guide conduit assembly rotates said cove plate with respect to said housing.

8. A drain cleaning apparatus according to claim 7, wherein said guide conduit assembly is removeably yet rigidly affixed to said cover plate.

9. A drain cleaning apparatus according to claim 6, wherein said housing includes a first indent and said cove plate includes a second indent and wherein said first indent aligns with said second indent when said rollers are in said neutral position, said drain cleaning apparatus further comprising a ball bearing and a spring inserted between said first and second indents when said first and second indents are aligned with one another.

10. A drain cleaning apparatus according to claim 7, wherein said housing includes a first indent and said copy plate includes a second indent and wherein said first indent aligns with said second indent when said rollers are in said neutral position, said drain cleaning apparatus further comprising a ball bearing and a spring inserted between said first and second indents when said first and second indents are aligned with one another.

11. A drain cleaning apparatus according to claim 1, wherein a position of an engagement surface at least one of said rollers within said inner bore is selectively adjustable.

12. A drain cleaning apparatus according to claim 5, wherein each of said carriers includes a pin extending therefrom and wherein said cover plate includes a plurality of cutout portions, each of said pins extending through a corresponding one of said cutout portions such that opposite edges of said cover plate defined by said corresponding ones of cutout portions engage said pins as said cover plate is rotated with respect to said housing whereby said carriers are rotated about said central axes.

13. A drain cleaning apparatus according to claim 1, wherein said guide conduit assembly comprises an adjusting tube and a guide tube, said guide tube being located concentrically within said adjusting tube, said guide tube being adopted to receive said cable.

14. A drain cleaning apparatus according to claim 1, wherein said guide conduit assembly comprises an inner guide spring having a plurality of first windings and an outer adjusting spring having a plurality of second windings, said inner guide spring and said outer adjusting spring being mounted such that said first and second windings are oppositely biased.

15. A drain cleaning apparatus according to claim 14, wherein each of said second windings contacts one of said first windings.

16. A drain cleaning apparatus according to claim 14, said guide conduit assembly further comprising a protective coating enclosing said inner guide spring and said outer adjusting spring.

17. A drain cleaning apparatus according to claim 1, wherein said cable displacing position comprises a firs cable displacing position in which said cable, when rotating in said first direction, is moved along said feed axis in a first feed direction and a second cable displacing position in which said cable when, rotating in said first direction, is moved along said feed axis in a second feed direction opposite said first feed direction, said rollers being selectively adjustable between said first cable displacing position and said second cable displacing position by rotation of said guide conduit assembly about said longitudinal axis.

* * * * *

UNITED STATES PATENT AND TRADEMARK OFFICE

CERTIFICATE OF CORRECTION

PATENT NO. : 6,637,064 B2
DATED : October 28, 2003
INVENTOR(S) : Lee H. Silverman and Arthur A. Silverman It is certified that error appears in the above-identified patent and that said Letters Patent is hereby corrected as shown below:

Column 9,
Line 30, 35, “cove” should be -- cover --.
Line 43, “copy” should be -- cover --.

Column 10,
Line 36, “firs” should be -- first --.

Signed and Sealed this

First Day of June, 2004

JON W. DUDAS
*Acting Director of the United States Patent and Trademark Office*